US009734958B2

(12) United States Patent
Hußmann

(10) Patent No.: US 9,734,958 B2
(45) Date of Patent: Aug. 15, 2017

(54) METHOD FOR CLOSING A SWITCH AND SWITCH FOR PERFORMING THE METHOD

(71) Applicant: Siemens Aktiengesellschaft, Munich (DE)

(72) Inventor: Jörg Hußmann, Neumarkt (DE)

(73) Assignee: SIEMENS AKTIENGESELLSCHAFT, Munich (DE)

( * ) Notice: Subject to any disclaimer, the term of this patent is extended or adjusted under 35 U.S.C. 154(b) by 212 days.

(21) Appl. No.: 14/421,891

(22) PCT Filed: Aug. 22, 2013

(86) PCT No.: PCT/EP2013/067437
§ 371 (c)(1),
(2) Date: Feb. 16, 2015

(87) PCT Pub. No.: WO2014/033039
PCT Pub. Date: Mar. 6, 2014

(65) Prior Publication Data

US 2015/0206667 A1 Jul. 23, 2015

(30) Foreign Application Priority Data

Aug. 31, 2012 (DE) ..... 10 2012 215 479

(51) Int. Cl.
*H01H 1/44* (2006.01)
*H01H 1/50* (2006.01)
(Continued)

(52) U.S. Cl.
CPC ..... *H01H 1/50* (2013.01); *H01H 1/36* (2013.01); *H01H 1/42* (2013.01); *H01H 33/121* (2013.01)

(58) Field of Classification Search
CPC ..... H01H 1/44; H01H 33/10; H01H 33/122; H01H 1/12; H01H 1/14; H01H 1/20;
(Continued)

(56) References Cited

U.S. PATENT DOCUMENTS 4,321,436 A 3/1982 McGarrity
5,834,717 A * 11/1998 Neumeyer ..... H01H 25/06 200/11 TC

FOREIGN PATENT DOCUMENTS

CN 101882508 A 11/2010
DE 714084 C 11/1941
(Continued)

OTHER PUBLICATIONS

Chinese Office Action mailed Mar. 11, 2016.
(Continued)

*Primary Examiner* — Anthony R. Jimenez
(74) *Attorney, Agent, or Firm* — Harness, Dickey & Pierce, P.L.C.

(57) ABSTRACT

An embodiment relates to a method for closing a switch and a switch for performing the method, the switch having a stationary switch contact including a stationary contact face, a movable switch contact including a movable contact face parallel to the stationary contact face and lying under pressure against the stationary contact face in the closed state, and an elastic transversal offset of the contact faces which ensures that pressure is applied when the contact surfaces lie against each other. To guarantee closing during a short-circuit, a displaceable counter-pressure element is provided which presses against the movable contact face in the open position and at least reduces the transversal offset. The counter-pressure element moves in conjunction with the movable switch contact towards the closed position when the switch closes. The counter-pressure element stops mov-
(Continued)

ing during the closing movement, while the movable contact face continues to move into the closed position.

6 Claims, 4 Drawing Sheets

(51) Int. Cl.
*H01H 1/42* (2006.01)
*H01H 33/12* (2006.01)
*H01H 1/36* (2006.01)

(58) Field of Classification Search
CPC .. H01H 1/22; H01H 1/36; H01H 1/38; H01H 1/42; H01H 1/50; H01H 3/00; H01H 3/001; H01H 3/02; H01H 3/32; H01H 3/52; H01H 3/60; H01H 71/00; H01H 71/10; H01H 71/50; H01H 71/52; H01H 33/121; H01H 2001/00; H01H 33/36; H01H 2003/00; H01H 33/02; H01H 33/32; H01H 33/46; H01H 2009/00; H01H 2009/20; H01H 2009/30; H01H 2221/04; H01H 2221/044; H01H 2221/06; H01H 2221/058; H02B 13/00
USPC ..... 200/257
See application file for complete search history.

(56) References Cited

FOREIGN PATENT DOCUMENTS

| | | | |
|---|---|---|---|
| DE | 1540591 | A1 | 1/1970 |
| DE | 2437615 | B1 | 1/1976 |
| DE | 3338244 | A1 | 5/1985 |
| DE | 19612273 | C1 | 10/1997 |
| DE | 102005060633 | A1 | 6/2007 |
| EP | 2249359 | A1 | 11/2010 |

OTHER PUBLICATIONS

International Search Report PCT/ISA/210 for International Application No. PCT/EP2013/067437 Dated Dec. 10, 2013.
Written Opinion of the International Searching Authority PCT/ISA/237 for International Application No. PCT/EP2013/067437 Dated Dec. 10, 2013.
German Office Action mailed May 6, 2013 for corresponding German Application No. 102012215479.5.

* cited by examiner

METHOD FOR CLOSING A SWITCH AND SWITCH FOR PERFORMING THE METHOD

PRIORITY STATEMENT

This application is the national phase under 35 U.S.C. §371 of PCT International Application No. PCT/EP2013/067437 which has an International filing date of Aug. 22, 2013, which designated the United States of America, and which claims priority to German patent application no. 102012215479.5 filed Aug. 31, 2012, the entire contents of each of which are hereby incorporated herein by reference.

FIELD

At least one embodiment of the invention generally relates to a method for closing a switch and/or to a switch for performing the method.

BACKGROUND

Switches in the form of load disconnectors for low voltages are known and serve to connect and interrupt an electric current. A pole housing is provided for each current phase, the side walls of the pole housing bearing against one another. Each pole housing contains moving and fixed switching contacts, wherein the moving switching contacts are each located at the free end of a pivotable lever.

In order to open the switch, the contact areas of the switching contacts, which contact areas rest against one another, are separated from one another by a switching shaft, wherein the contact areas each run parallel to one another. The switching shaft runs transverse to the lever and to the side walls. Connection lugs to which connection cables can be connected are located at both ends of the switching shaft. Quenching plates which are arranged in the region of the switching contacts ensure that an arc which is produced when the switching contacts are separated is quenched.

The switching contacts are often in the form of blade contacts, one of which is stationary and the other of which moves.

In this case, upstream elements which are composed of a non-conductive material are provided, the elements causing spreading, so that the stationary or moving switching blade can enter during the connection process without a great deal of resistance. During connection, spreading initially takes place due to the application of force, and the moving or stationary contact blade is then inserted.

One disadvantage is that the connection speed is reduced by the spreading process.

SUMMARY

At least one embodiment of the invention is directed to a switch which ensures low-wear closing, in particular when closing in response to a short circuit.

A method and a switch are disclosed. Dependent claims are advantageous refinements.

An embodiment of the method makes provision for a moving counter-pressure element to press the moving contact area in the direction of the common contact plane in the open position, as a result of which the transverse offset is at least reduced, for the counter-pressure element to be moved in the direction of the closed position together with the moving switching contact when the switch is closed, and for the counter-pressure element to be stopped during the course of the closing movement, while the moving contact area continues to be moved until it is in the closed position.

An embodiment is directed to the switch. The switch makes provision for a moving counter-pressure element to be provided, the moving counter-pressure element pressing against the moving contact area in the open position and at least reducing the transverse offset, for the counter-pressure element to be moved in the direction of the closed position together with the moving switching contact when the switch is closed, and for the counter-pressure element to stay still during the course of the closing movement, while the moving contact area continues to move into the closed position.

BRIEF DESCRIPTION OF THE DRAWINGS

The invention is described in greater detail below with reference to an example embodiment. In the drawings.

DETAILED DESCRIPTION OF THE EXAMPLE EMBODIMENTS

Figure 1:
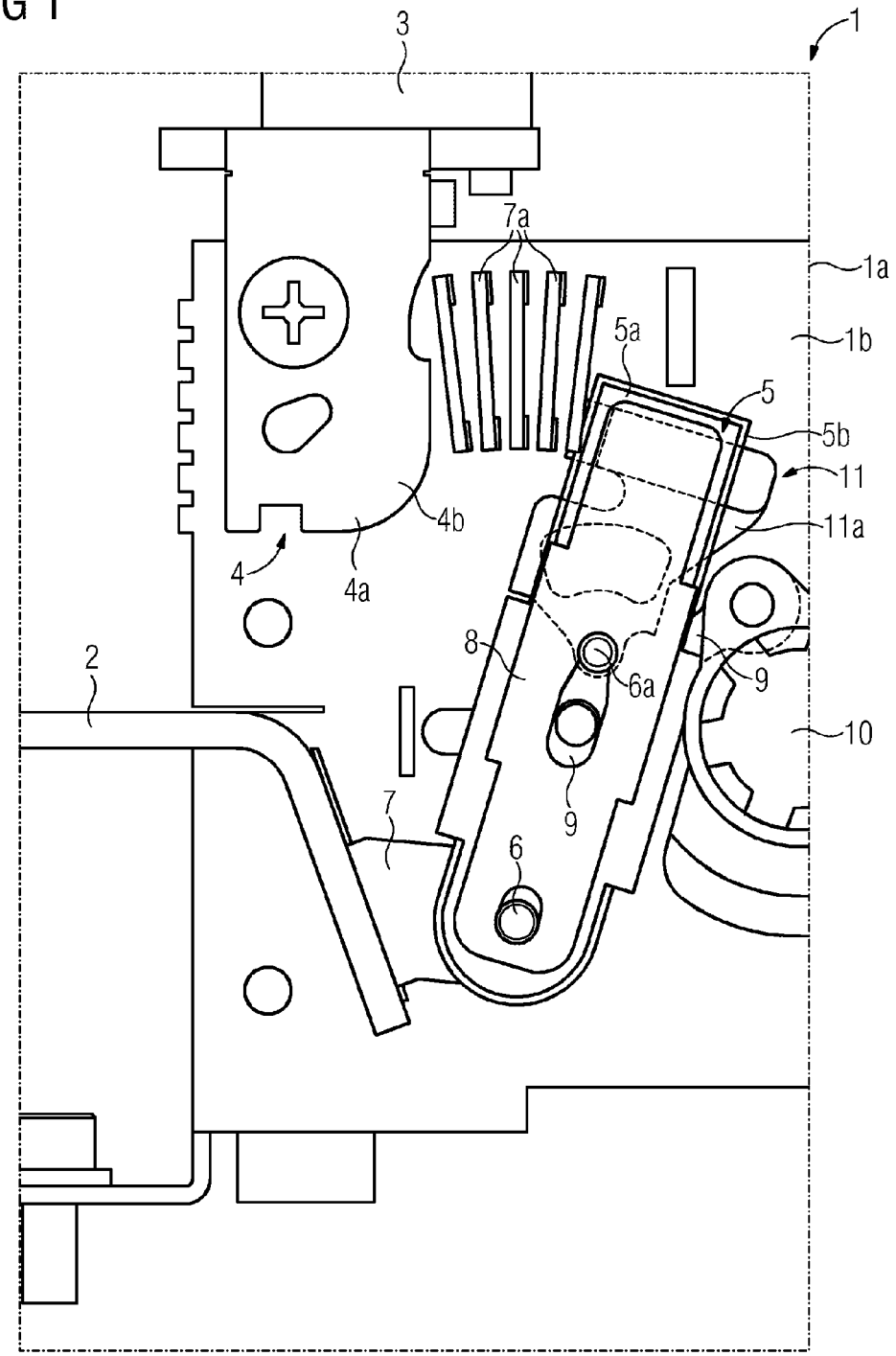
FIG. 1 shows an open switch.

An embodiment of the method makes provision for a moving counter-pressure element to press the moving contact area in the direction of the common contact plane in the open position, as a result of which the transverse offset is at least reduced, for the counter-pressure element to be moved in the direction of the closed position together with the moving switching contact when the switch is closed, and for the counter-pressure element to be stopped during the course of the closing movement, while the moving contact area continues to be moved until it is in the closed position.

It is especially advantageous when the moving contact area is moved in each case in the contact plane or in a plane which is parallel to the contact plane before and after stopping, and that the moving contact area, after stopping, slides into the closed position in a manner bearing against the counter-pressure element and/or against the stationary contact area. The energy which is present during opening can best be utilized when the moving contact area is pressed in the direction of the common contact plane during the course of the opening movement.

An embodiment is directed to the switch. The switch makes provision for a moving counter-pressure element to be provided, the moving counter-pressure element pressing against the moving contact area in the open position and at least reducing the transverse offset, for the counter-pressure element to be moved in the direction of the closed position together with the moving switching contact when the switch is closed, and for the counter-pressure element to stay still during the course of the closing movement, while the moving contact area continues to move into the closed position.

It is especially advantageous when the moving contact area is in each case moved in the contact plane or in a plane which is parallel to the contact plane before and after stopping, and that the moving contact area, after stopping, slides into the closed position in a manner bearing against the counter-pressure element and/or against the stationary contact area, the moving contact area only bearing against the stationary contact area in the closed position.

In order to stop the counter-pressure element during the course of the closing movement, it is proposed that the counter-pressure element butts against a stationary stop during the course of the closing movement.

A technically simple solution of an embodiment makes provision for the stop to be formed by the stationary switching contact. Reliable closing is achieved when the moving contact area slides on the stationary contact area into the closed position.

A particularly reliable design is obtained when the moving switching contact is in the form of spring-action contact elements which face one another, and the stationary switching contact is in the form of a contact blade (contact plate), the contact blade sliding between the spring-action contact elements during the course of the closing movement.

A simple elastic design makes provision for the contact elements to be in the form of contact springs.

It is particularly expedient from an energetic point of view when the counter-pressure element presses the moving contact area in the direction of the common contact plane during the course of the opening movement.

The schematic illustration in FIG. 1 shows an open switch 1 in the form of a load disconnector for low voltages which serves to connect and disconnect an electric current. The switch 1 has a plurality of pole housings 1*a*, the side walls 1*b* of the pole housings bearing against one another. An open pole housing 1*a* is illustrated in FIG. 1, which shows the switch 1 in its open position.

Current is connected via connection lugs 2, 3 to which appropriate current cables are connected from the outside (not shown). The connection lug 3 is connected to a stationary switching contact 4 which is in the form of a contact blade 4*a*. A moving switching contact 5 is in the form of a lever 8 and can be pivoted about a rotation shaft 6. The lever 8 has spring-action contact elements 5*a* at its free end, the contact elements having two contact areas 5*b* which face one another. The lever end which is rotatably mounted on the rotation shaft 6 is connected to the connection lug 2 by way of a conductive connecting piece 7. Quenching plates 7*a* for quenching an arc which is produced between the switching contacts 4, 5 when the switch 1 is opened are provided opposite the connecting piece 7.

A rod 9 connects the lever 8 to a switching shaft 10 in an articulated manner.

In order to open and close the switch 1, the lever 8 is appropriately pivoted by way of rotation of the switching shaft 10.

A plate-like pressure element 11 which is composed of electrically nonconductive material bears against the contact areas 5*b* of the spring-action contact elements 5*a*, the pressure element pressing the contact elements 5*a* and therefore the contact areas 5*b* apart. In this case, the pressure element acts as a spreading element 11*a* which elastically spreads the contact elements 5*a*. The distance between the contact areas 5*b*, on account of the spreading element 11*a*, amounts to the width of the contact blade 4*a* in this case (it goes without saying that the distance can also be greater than here in this embodiment).

The spreading element 11*a* can be freely pivoted about a rotation shaft 6*a* independently of the moving contact elements 5*a* and connected in a force-fitting manner to the contact elements 5*a* by way of the contact faces 5*b*.

Figure 2:
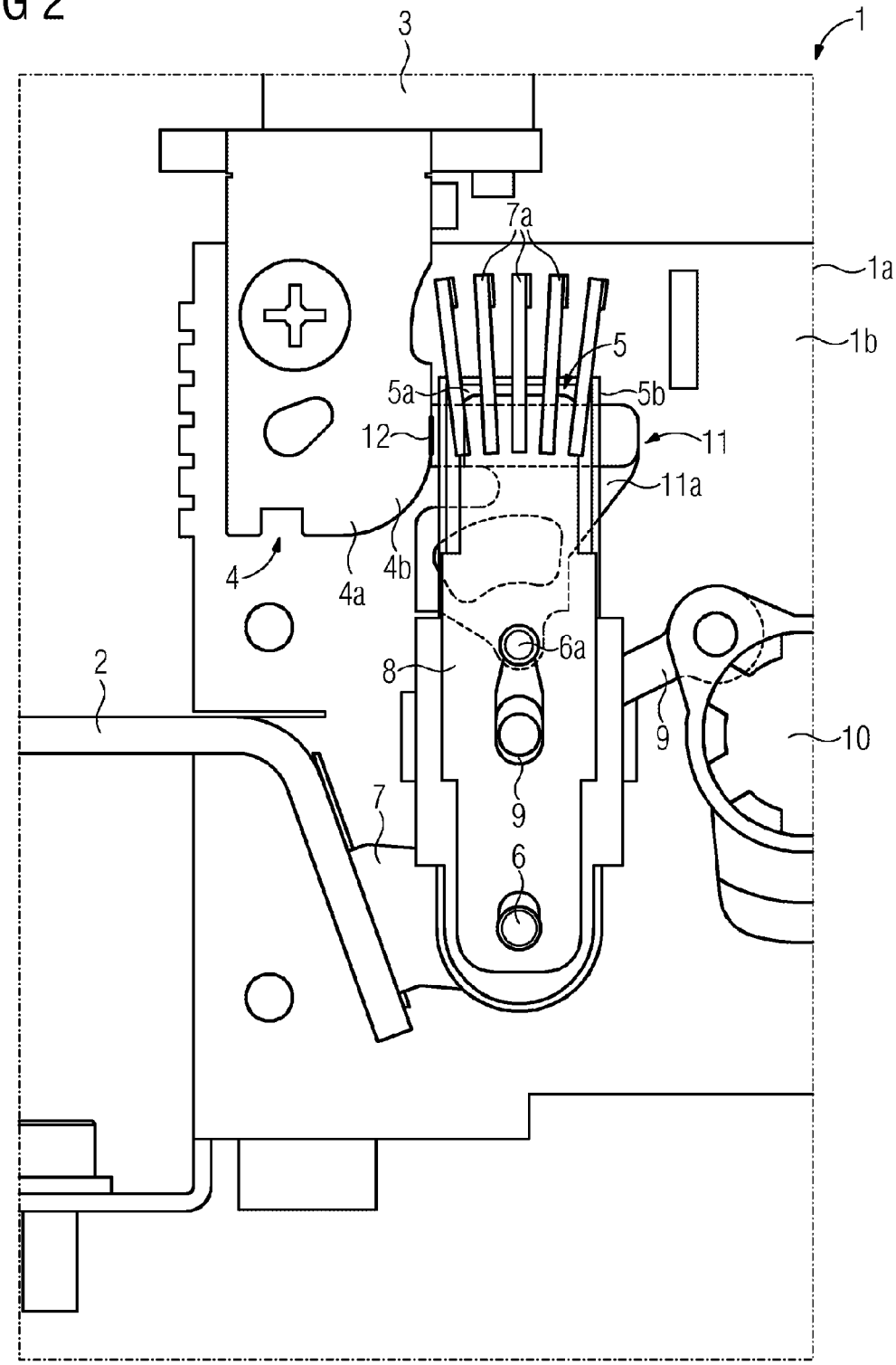
FIG. 2 shows the switch according to FIG. 1 in an intermediate position.

FIG. 2 shows the moving switching contact 5 during the connection movement together with the spreading element 11*a*, which is clamped between the contact elements 5*a*, in an intermediate position in which the spreading element 11*a* bears against a stop 12 which in this case is formed by an edge 12*a* of the stationary switching contact 4. By virtue of the clamping, the spreading element 11*a* is carried along in a simple manner as far as the stop 12 when the moving switching contact 5 is pivoted.

Figure 3:
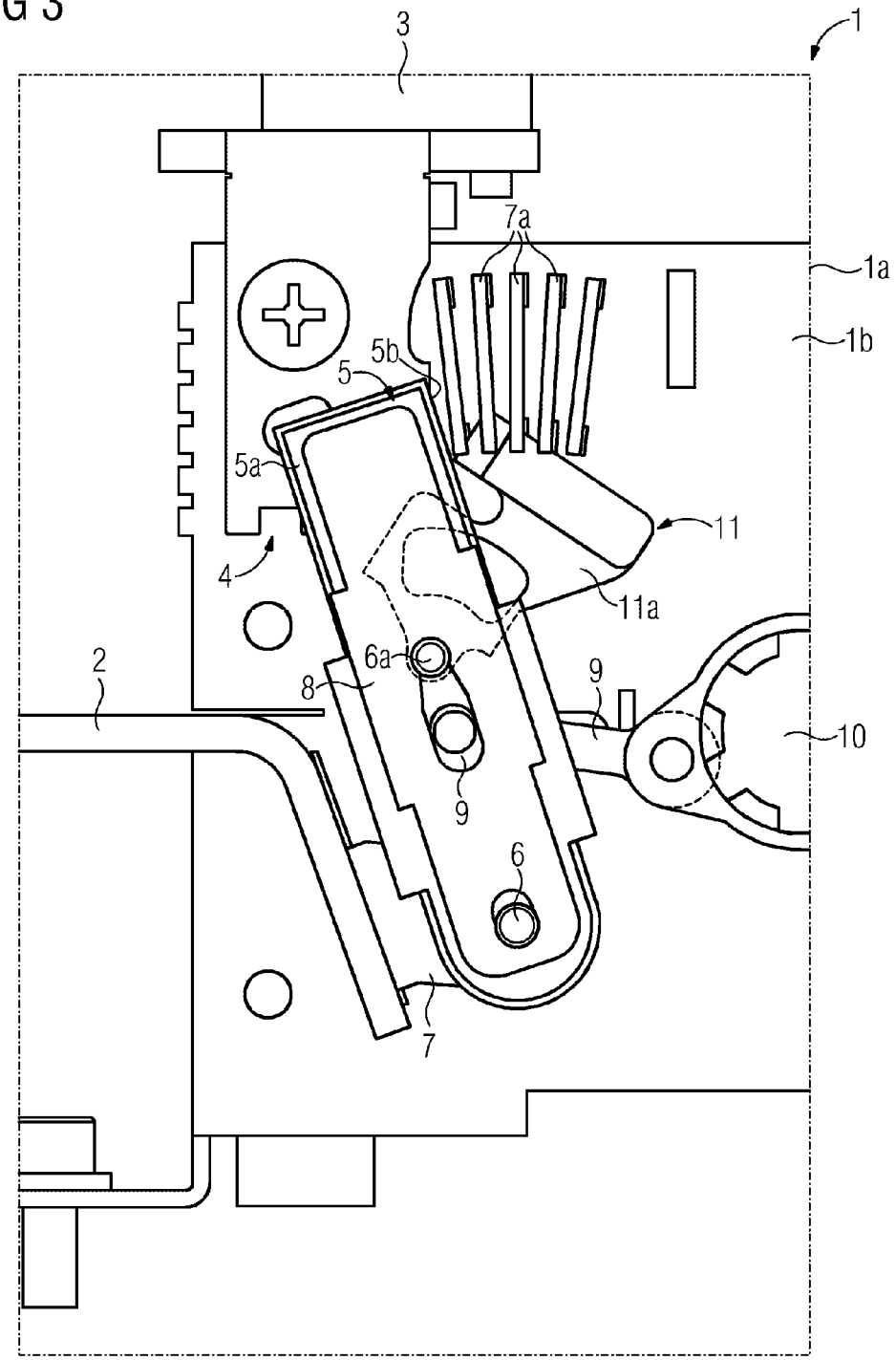
FIG. 3 shows the switch according to FIG. 1 in a connected state.

The moving switching contact 5 is in its closed position in FIG. 3. The moving contact areas 5*b* each bear against a (stationary) contact area 4*b* of the contact blade 4*a*, with pressure being applied. In each case two contact faces 4*b*, 5*b* lie in a common plane, these planes being called contact planes in the text which follows. The contact blade 4*a* for its part lies in the same plane as the plate-like counter-pressure element 11, called the contact blade plane in this case. There are therefore two contact planes which are spaced apart from one another and between which the contact blade plane lies in the center.

Without the spreading element 11*a*, the moving contact areas 5*b* would have a transverse offset in relation to the contact planes during the closing process in the intermediate position, the transverse offset being almost compensated for by the spreading element 11*a* owing to the spreading (it goes without saying that it may also be overcompensated in comparison to here in this embodiment).

In this case, the moving contact areas 5*b* in each case move in the contact plane or in a plane which is parallel to the contact plane in front of and behind the stop 12, and slide into the closed position behind the stop 12 in a manner bearing against the stationary contact area 4*b* (and under certain circumstances also further against the counter-pressure element 11).

Owing to the spreading element 11*a*, the moving switching contacts 5 move into their closed position, in which the contact areas 4*b*, 5*b* bear against one another with pressure being applied, virtually without hindrance and in an extremely short time during the course of the closing movement. The application of pressure is created by the transverse offset and corresponds approximately to the force with which the counter-pressure element 11 presses apart the spring-action contact elements 5*a* (for compensation of the transverse offset).

In this case, compensation of the transverse offset means that the contact faces 4*b*, 5*b* move into the closed position in a manner sliding against one another (or at a distance from one another in the event of overcompensation) and in the process make contact with one another, wherein the effective touch area in the contact region continuously increases in size (suddenly in the event of overcompensation in the closed position). The delaying effect of the friction between the contact areas 4*b*, 5*b* is negligible. The spreading process, which requires time and force, is completely dispensed with since the contact elements 5*a* are already pushed apart.

In the connection process, the stationary switching contact 4 which is in the form of a contact blade 4*a* enters the moving gap without reducing the connection speed, the gap being formed by the contact areas 5*b* of the contact elements 5*a*, wherein the spreading element 11*a* is successively replaced by the contact blade 4*a*.

However, it is also possible, in principle, for the transverse offset to not be completely compensated for (eliminated) by the counter-pressure element 11, but rather only be reduced, so that a (small) transverse offset remains. It is further possible for the transverse offset to be overcompensated, so that the contact areas 4*b*, 5*b* meet only in the closed position.

Spreading takes place during the course of the opening movement in the case of which the spreading element 11*a* initially butts against the contact elements 5*a* and is carried along until it stops against a stop on the right-hand side with reference to FIG. 3, while the contact elements 5*a* continue to move in the direction of the stop and are pressed apart by the spreading element 11*a* owing to the force of the disconnection movement by way of the switching shaft 10.

In this way, the connection process of the switching contacts 4, 5 takes place with less force and at a higher switching speed. Relatively high switching speeds generally permit relatively high powers to be switched. The functional principle can be transferred to all switches which comprise at least one stationary and one moving switching contact 4, 5 which are generally in the form of blade contacts.

Figure 4:
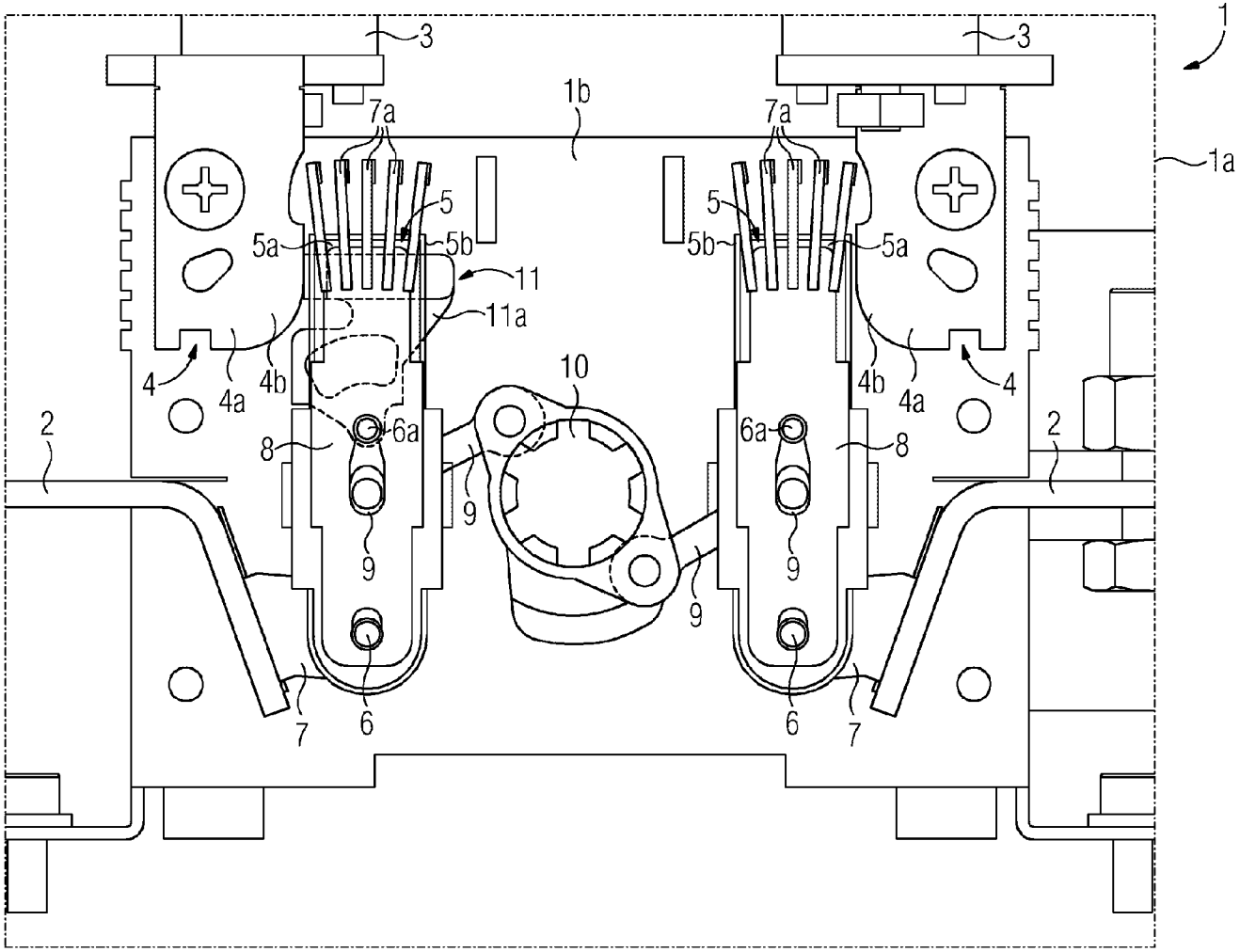
FIG. 4 shows the switch according to FIG. 2 with double contact.

FIG. 4 shows the switch 1 according to FIG. 2 with double the number of switching contacts 4, 5.

The invention claimed is:

1. A method for closing a switch, the switch including a stationary contact area and a moving contact area, the moving contact area being movable from an open position to a closed position in which the moving contact area bears against the stationary contact area, the two contact areas lying in a common contact plane, and the two contact areas each running parallel to one another and including an elastic transverse offset in the open position, the contact areas being pressed against one another by the transverse offset in the closed position, the method comprising:

pressing, via a moving counter-pressure element, the moving contact area in a direction of the common contact plane in the open position, as a result of which a transverse offset is at least reduced;

moving the counter-pressure element in a direction of the closed position together with the moving switching contact when the switch is closed; and stopping the counter-pressure element during a course of a closing movement, while the moving contact area initially continues to be moved, in a sliding manner on the counter-pressure element, until it is in the closed position, wherein the moving contact area is moved in the contact plane or in a plane which is parallel to the contact plane before and after stopping, wherein the moving contact area, after stopping, slides into the closed position in a manner bearing against at least one of the counter-pressure element and the stationary contact area, wherein the counter-pressure element butts against a stationary stop, formed by the stationary switching contact, during the course of the closing movement.

2. The method of claim 1, wherein the moving contact area is pressed in the direction of the common contact plane during a course of an opening movement.

3. A switch, comprising:

a stationary switching contact, including a stationary contact area;

a moving switching contact, including a moving contact area, wherein the two contact areas each run parallel to one another, the switch including an open position and a closed position into which the moving contact area is movable, wherein the moving contact area bears against the stationary contact area, with pressure being applied, in the closed position, and including an elastic transverse offset of the contact areas in the open position; and a counter-pressure element, the counter-pressure element pressing against the moving contact area in the open position and at least reducing the transverse offset, the counter-pressure element being moved in a direction of the closed position together with the moving switching contact when the switch is closed, and the counter-pressure element staying still during a course of an closing movement, while the moving contact area continues to move into the closed position, wherein the moving contact area is moved in a contact plane or in a plane which is parallel to the contact plane before and after stopping, wherein the moving contact area, after stopping, slides into the closed position in a manner bearing against at least one of the counter-pressure element and the stationary contact area, wherein the counter-pressure element butts against a stationary stop during the course of the closing movement, and wherein the stop is formed by the stationary switching contact.

4. The switch of claim 3, wherein the touch area between the switching contacts increases in size during the course of the closing movement when the moving contact area slides into the closed position in a manner bearing against the stationary contact area.

5. The switch of claim 3, wherein the stationary switching contact is in the form of a contact blade, and the moving switching contact is in the form of spring-action contact elements which face one another, the contact blade sliding between the spring-action contact elements during the course of the closing movement.

6. The switch of claim 3, wherein the counter-pressure element presses the moving contact area in the direction of the common contact plane during a course of an opening movement.

* * * * *